US007907161B2

(12) United States Patent
Clark

(10) Patent No.: US 7,907,161 B2
(45) Date of Patent: Mar. 15, 2011

(54) ADAPTIVE CORRECTION SYSTEM

(75) Inventor: Timothy James Clark, Marion, NY (US)

(73) Assignee: Xerox Corporation, Norwalk, CT (US)

( * ) Notice: Subject to any disclaimer, the term of this patent is extended or adjusted under 35 U.S.C. 154(b) by 145 days.

(21) Appl. No.: 12/248,442

(22) Filed: Oct. 9, 2008

(65) Prior Publication Data

US 2010/0091081 A1 Apr. 15, 2010

(51) Int. Cl.
*B41J 2/435* (2006.01)
*B41J 2/47* (2006.01)

(52) U.S. Cl. ..... 347/234; 347/248

(58) Field of Classification Search ..... 347/233–237, 347/246–250
See application file for complete search history.

(56) References Cited

U.S. PATENT DOCUMENTS 5,461,412 A * 10/1995 Paoli et al. ..... 347/243
5,684,523 A * 11/1997 Satoh et al. ..... 347/247
7,408,567 B2 * 8/2008 Ishikawa et al. ..... 347/246

* cited by examiner

*Primary Examiner* — Hai C Pham
(74) *Attorney, Agent, or Firm* — Oliff & Berridge, PLC

(57) ABSTRACT

Adaptive correction techniques are disclosed that adaptively correct aberrations which may arise in systems such as laser printers, for example. For laser printers, calibration data processing results may be detected by a detector that is disposed to correspond physically to the recording medium so that characteristics such as position and intensity of a laser beam at the detector corresponds to that of a laser beam at the recording medium. In this way, aberrations in system performance may be adaptively corrected while the system is performing operational processes.

18 Claims, 15 Drawing Sheets

FIG. 4A
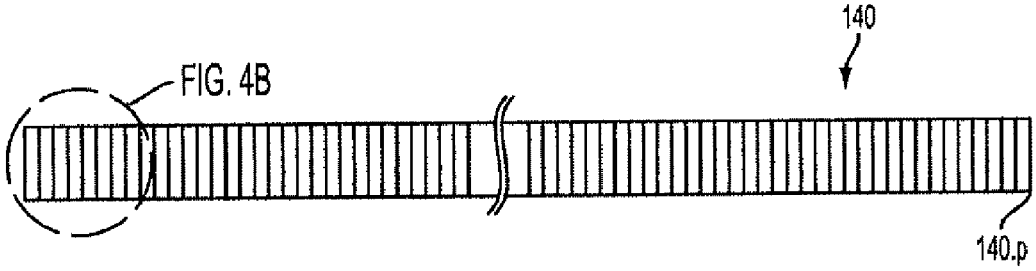
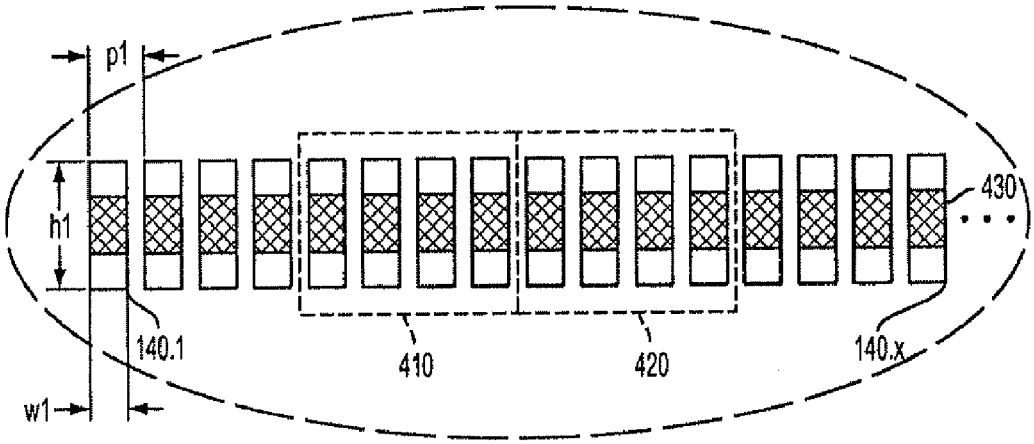
FIG. 4B

700

| DETECTED DATA | BP1 | BP2 | BP3 | BP4 | ... | BPm |
|---|---|---|---|---|---|---|
| F1 | 250 | 250 | 250 | 250 | ... | 250 |
| F2 | 250 | 250 | 230 | 230 | ... | 250 |
| F3 | 250 | 250 | 250 | 250 | ... | 250 |
| F4 | 250 | 250 | 250 | 250 | ... | 250 |
| ... | ... | ... | ... | ... | ... | ... |
| Fn | 250 | 250 | 250 | 250 | ... | 250 |

FIG. 7

800

| CORRECTION MAP | CP1 | CP2 | CP3 | CP4 | ... | CPk |
|---|---|---|---|---|---|---|
| F1 | 0 | 0 | 0 | 0 | ... | 0 |
| F2 | 0 | 0 | 20 | 20 | ... | 0 |
| F3 | 0 | 0 | 0 | 0 | ... | 0 |
| F4 | 0 | 0 | 0 | 0 | ... | 0 |
| ... | ... | ... | ... | ... | ... | ... |
| Fn | 0 | 0 | 0 | 0 | ... | 0 |

FIG. 8

| DETECTED DATA | BP1 | BP2 | BP3 | BP4 | ··· | BPm |
|---|---|---|---|---|---|---|
| F1 | 1,0,0,0 | 1,1,0,0 | 0,1,1,0 | 0,1,1,0 | ··· | 0,0,0,1 |
| F2 | 1,0,0,0 | 1,1,0,0 | 0,1,1,0 | 0,1,1,0 | ··· | 0,0,0,1 |
| F3 | 1,0,0,0 | 1,1,0,0 | 0,1,1,0 | 0,1,1,0 | ··· | 0,0,0,1 |
| F4 | 1,0,0,0 | 1,1,0,0 | 0,1,1,0 | 0,1,1,0 | ··· | 0,0,0,1 |
| ··· | ··· | ··· | ··· | ··· | ··· | ··· |
| Fn | 1,0,0,0 | 1,1,0,0 | 0,1,1,0 | 0,1,1,0 | ··· | 0,0,0,1 |

1300

| CORRECTION MAP | CP1 | CP2 | CP3 | CP4 | ... | CPk |
|---|---|---|---|---|---|---|
| F1 | -2 | -1 | 0 | 0 | ... | 2 |
| F2 | -2 | -1 | 0 | 0 | ... | 2 |
| F3 | -2 | -1 | 0 | 0 | ... | 2 |
| F4 | -2 | -1 | 0 | 0 | ... | 2 |
| ... | ... | ... | ... | ... | ... | ... |
| Fn | -2 | -1 | 0 | 0 | ... | 2 |

FIG. 13

ADAPTIVE CORRECTION SYSTEM

This disclosure is directed to systems and methods for adaptive correction of deviations arising in electronic image forming devices. The adaptive correction may be performed by comparing detected values with previously known desired or expected values, for example.

BACKGROUND

Electronic image forming devices are used for many purposes, such as scanning, copying, and printing. These image forming devices may include various optical elements, such as light emitting elements, lens elements and reflection elements. The performance of these optical devices may deteriorate over time based on a number of factors including wear, e.g. aging, and influences of environmental factors, such as temperature and humidity.

Conventional image forming devices do not contain a detector that allows for the device to perform adaptive correction. Rather, these conventional devices require a separate detection and calibration process, which cannot be performed during regular operation.

SUMMARY

Adaptive correction techniques are disclosed that adaptively correct aberrations that may arise in electronic image forming devices, such as printers, for example. In printers, aberrations may affect print quality in image distortions vertically down a page (slow scan direction) such as wobble banding, skewing, or bowing; horizontally across the page (fast scan direction) such as scan non-linearity, end-of-line jitter, or line magnification; or vertically or horizontally such as unevenness in image formation due to intensity deviations.

The disclosed adaptive correction techniques may adaptively correct such deviations by monitoring system performance using calibration data interspersed between operational data such as between pages or during other convenient times, collecting system performance based on the calibration data, and changing system operating parameters while processing the operational data. Calibration data processing results may be detected by a detector that is disposed to correspond physically to the recording medium so that characteristics such as position and intensity of a light beam at the detector correspond to those of the light beam at the recording medium. In this manner, system performance may be monitored and adjusted automatically during operation.

For example, the disclosed adaptive correction techniques may include a correction driver that provides capability to alter fast scan position and/or intensity of the light beam to compensate for deviations such as intensity variations as well as magnification, end-of-line jitter, etc. Further, the disclosed adaptive correction techniques may include capabilities to reorder input operational data for correcting slow scan aberrations such as skewing or bowing, for example. In this way, aberrations in system performance may be adaptively corrected while the system is performing operational processes.

BRIEF DESCRIPTION OF THE DRAWINGS

FIG. 4A shows an exemplary detector;

FIG. 4B shows an enlarged portion of the exemplary detector;

FIG. 7 shows exemplary detected data;

FIG. 8 shows an exemplary correction map;

FIG. 13 shows an exemplary correction map;

EMBODIMENTS

Figure 1:
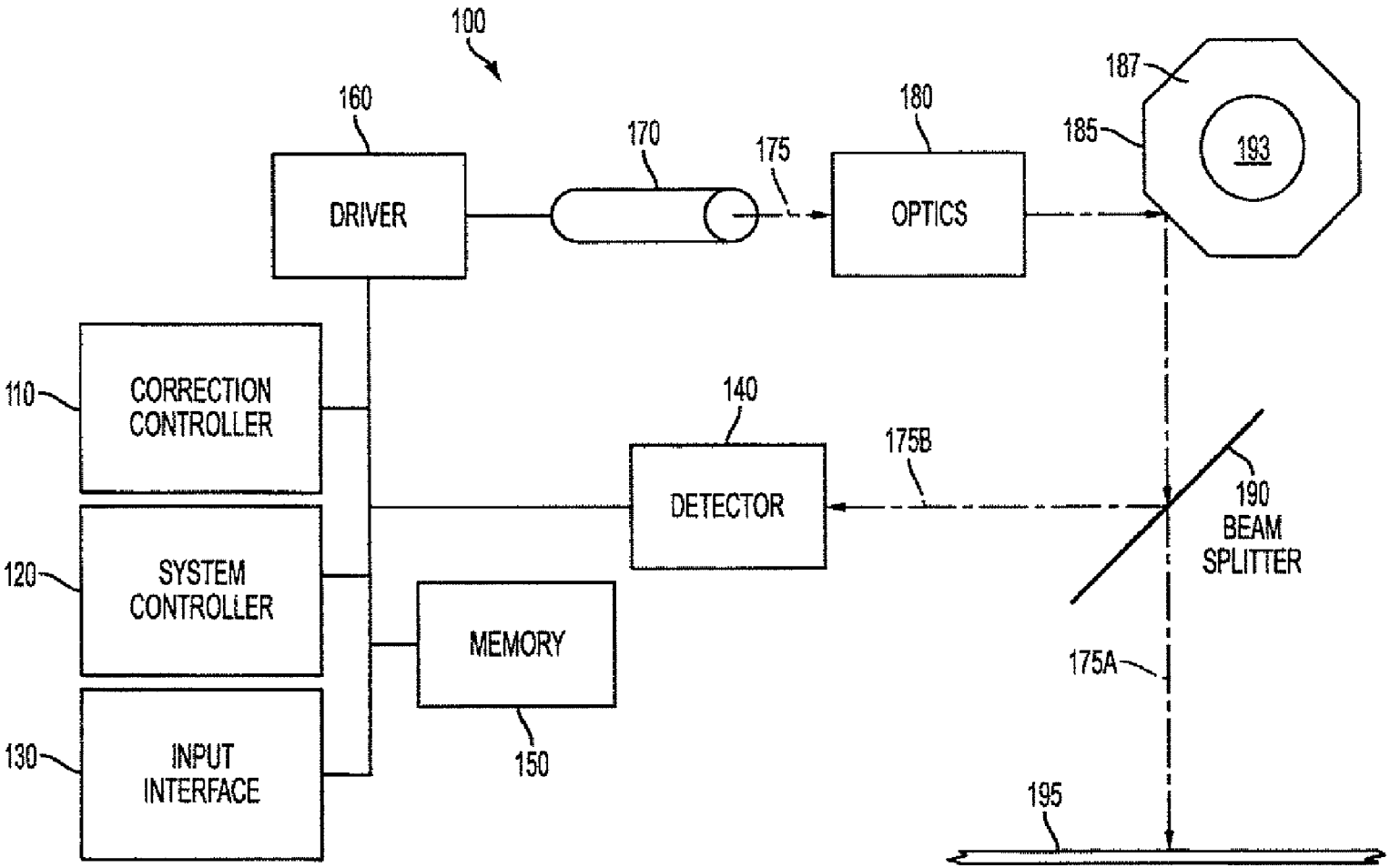
FIG. 1 illustrates a schematic block diagram of an exemplary embodiment of an adaptive correction system according to the disclosure.
Figure 2:
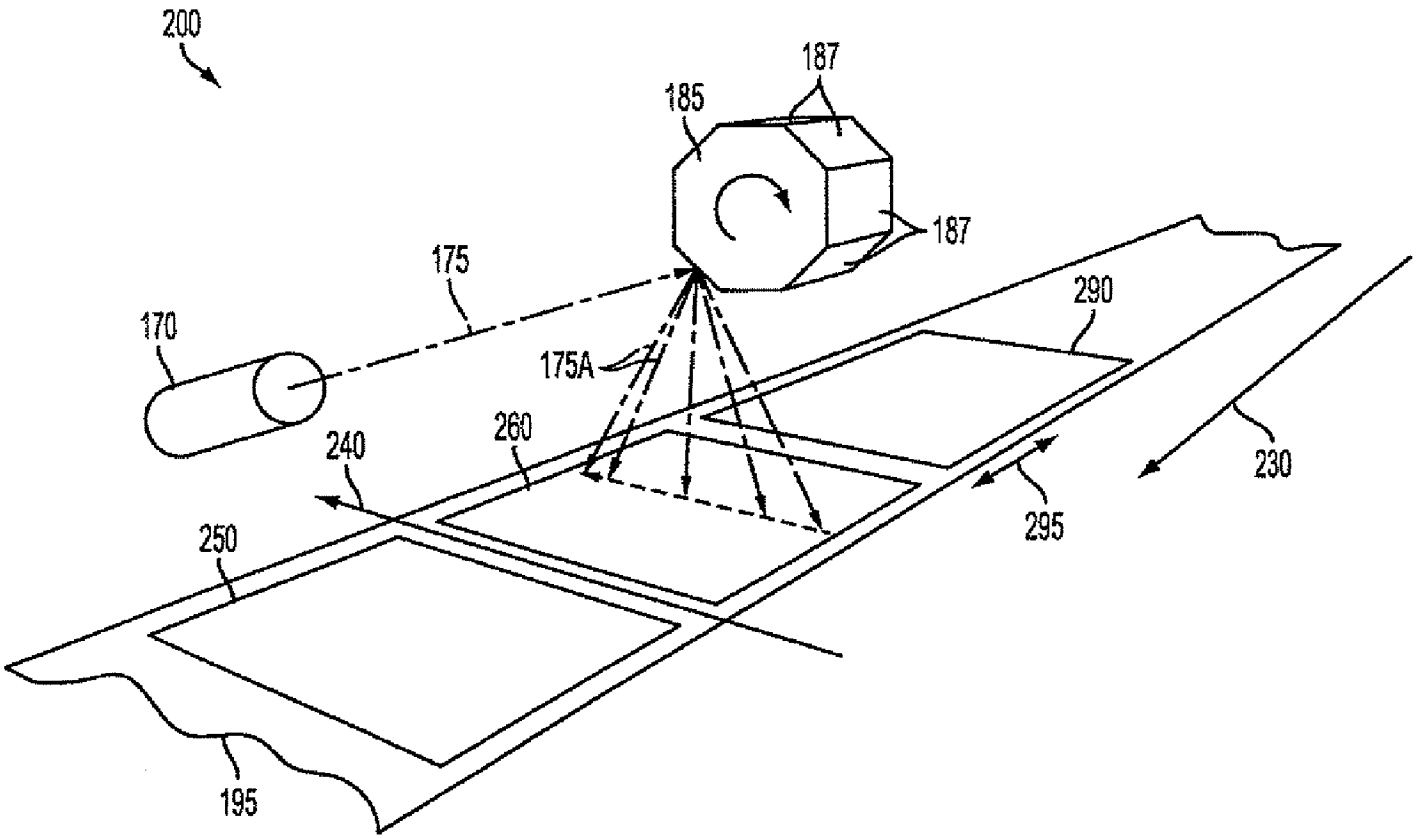
FIG. 2 illustrates a perspective view of the exemplary embodiment of the adaptive correction system.

FIGS. 1 and 2 shows an exemplary adaptive correction system 100. Adaptive correction system 100 includes a detector 140 that allows the system to detect characteristics of a light beam emitted by a light beam emitter 170 and to compare these detected values with previously known desired or expected values. Adaptive correction system 100 may also include a correction controller 110, a system controller 120, an input interface 130, a memory 150, a light beam driver 160, optics 180 and 188, a polygon mirror 185 having mirror facets 187, a beam splitter 190, a motor 193 and a photoreceptor belt 195. While correction controller 110, system controller 120, input interface 130, detector 140, memory 150, and driver 160 are shown to be connected using a bus architecture, other hardware architectures may be used provided that the hardware architecture allows these components in adaptive correction system 100 to communicate with each other as disclosed below.

Input interface 130 receives data from a data source, such as a scanner of a copier, and the data may be stored in memory 150 either directly or through system controller 120, or the data may be processed by system controller 120 without being first stored. System controller 120 may process the data to calculate, for example, driver control signals and send the driver control signals to correction controller 110 for adaptive correction processing, generating corrected driver control signals for controlling driver 160.

Light beam emitter 170 generates a light beam 175 based on the corrected driver control signals received from system controller 120. Light beam 175 passes through optics 180, reflects from a mirror facet 187 of polygon mirror 185, passes through additional optics 188, and is split by beam splitter 190 into a first or transmitted beam 175A and a second or reflected beam 175B. Transmitted beam 175A writes an electrostatic charge pattern of an image by altering electrostatic charge values on photoreceptor belt 195. Charged toner is placed onto photoreceptor belt 195 based on the electrostatic charge pattern, and the toner is placed onto an image writing portion through an electrostatic attaching process.

As photoreceptor belt 195 is moved in a slow scanning direction 230, transmitted beam 175A is scanned in a fast scan direction 240 by polygon mirror 185 across an image writing portion such as image writing portions 250, 260 and 290.

Motor 193 rotates polygon mirror 185 while light beam 175 is reflected from one of mirror facets 187. Thus, light beam 175 is moved in fast scan direction 240. The rotation of polygon mirror 185 and movement of photoreceptor belt 195 are coordinated so that each mirror facet 187 of polygon mirror 185 corresponds to one line in fast scan direction 240, and image writing portion 260 corresponds to a page, for example.

A sync pulse may be provided that indicates a beginning of each line on image writing portion 260. Sync pulses may be generated based on a detector which generates the sync pulse at a specific position of each mirror facet 187 relative to light beam 175, for example. Additionally, a physical mark on the polygon mirror 185 and a detection system for detecting the physical mark, or a detection system of some other means may provide an index pulse to indicate the location of facet one for facet tracking purposes.

Figure 3A:
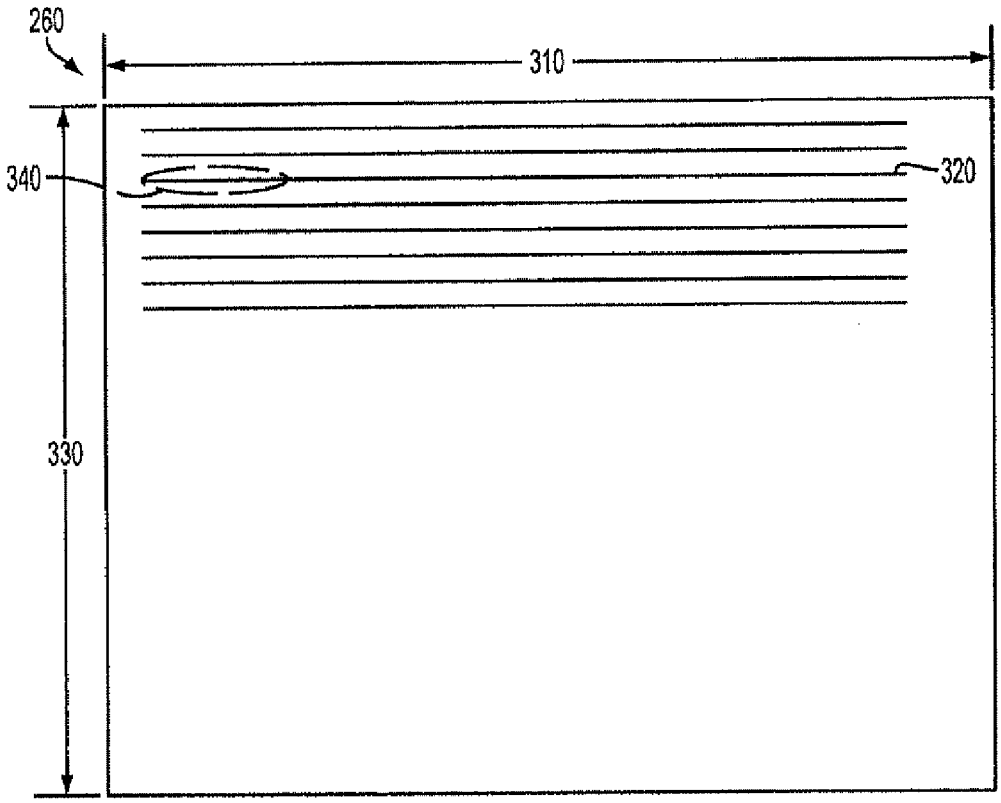
FIG. 3A illustrates an exemplary embodiment of an image writing portion.
Figure 3B:
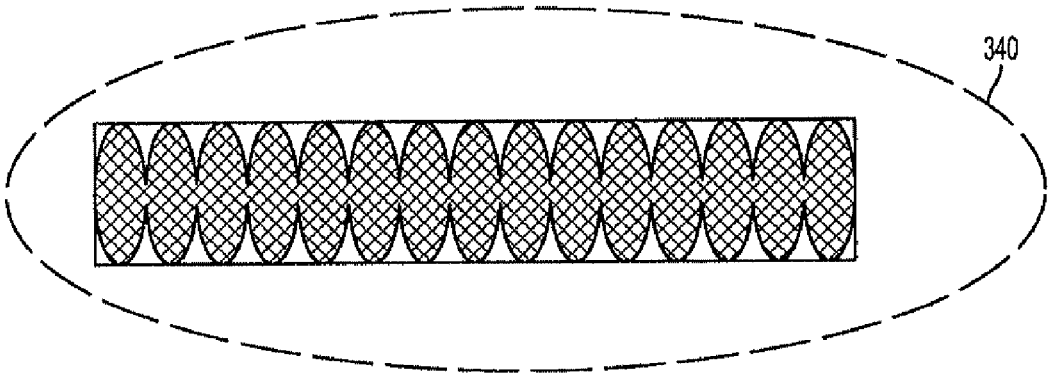
FIG. 3B illustrates an enlarged portion of the exemplary embodiment of an image writing portion.

FIG. 3A shows an exemplary image writing portion 260, having a length 310 and a width 330, and FIG. 3B shows an enlarged portion of the exemplary image writing portion. Image writing portion 260 may be moved along slow scan direction 230 by photoreceptor belt 195 as transmitted beam 175A sweeps across image writing portion 260, in fast scan direction 240, while being modulated by driver 160 to generate an image for a page to be printed.

Driver 160 may generate a sequence of pulses to drive light beam emitter 170. Each generated pulse may correspond to a dot forming a pixel on photoreceptor belt 195. As light beam 175 is swept in fast scan direction 240, a sequence of dots is generated forming a scan line 320. A line may be drawn across a page by firing light beam emitter 170 continuously, for example. A portion 340 of scan line 320 is expanded in FIG. 3 to show a sequence of dots forming a line. Spacing of dots along fast scan direction 240 and spacing of lines along slow scanning direction 230 may be adjusted based on relative movement speeds of polygon mirror 185, photoreceptor belt 195 and timing of the sequence of pulses.

When generating a printed page, driver 160 maybe modulated by data received from input interface 130. For text, data may be binary 1s and 0s. Thus, driver 160 generates a sequence of pulses having amplitudes corresponding to 1s and 0s based on the data to generate the printed page.

As shown in FIG. 2, a portion 295 of photoreceptor belt 195 may be unused for printing. Portion 295 may be a portion between consecutive writing portions 250, 260 and 290 used for printed pages or may be unusable portions of photoreceptor belt 195, for example, where ends of a photoreceptor strip are stitched together at a seam to form photoreceptor belt 195. Portion 295 may be used for calibration purposes. When a portion 295 is in position, adaptive correction system 100 may feed calibration data to driver 160 to detect attributes of various components for adaptive compensation of aberrations arising in the device.

Returning to FIG. 1, reflected beam 175B may be directed toward detector 140. Detector 140 and photoreceptor belt 195 may be disposed so that positions of transmitted beam 175A on the photoreceptor belt 195 map consistently with positions of reflected beam 175B on detector 140. Thus, attributes of reflected beam 175B on the detector 140, such as intensity and position, should correspond to attributes of transmitted beam 175A on the photoreceptor.

FIG. 4A shows an exemplary embodiment of detector 140 that may include sensors 140.1-140.p (where p is an arbitrary positive integer). FIG. 4B shows sensors 140.1-140.x which maybe a small portion of detector 140. Sensors may be grouped into groups such as groups 410 and 420 where each group of sensors corresponds to a single dot (or patch of dots) formed on photoreceptor belt 195. A number of sensors in each group may be set as desired based on detection goals. Each of sensors 140.1-140.p may detect an intensity of reflected beam 175B at the particular position of each of the respective sensors. Thus, detector 140 may detect an actual position of reflected beam 175B which corresponds to an actual position of transmitted beam 175A on photoreceptor belt 195.

The sensors may have parameters such as a height h1, a width w1, and a pitch (separation distance) p1. These parameters may be set based on detection needs. For example, height h1 may be set for detecting a range of possible light dot vertical positions and/or light dots generated by a vertical stack of multiple light beams that are swept across the scan line direction. Width w1 and pitch p1 may be set based on a desired scan line and light dot detection resolutions, for example.

Figure 15:
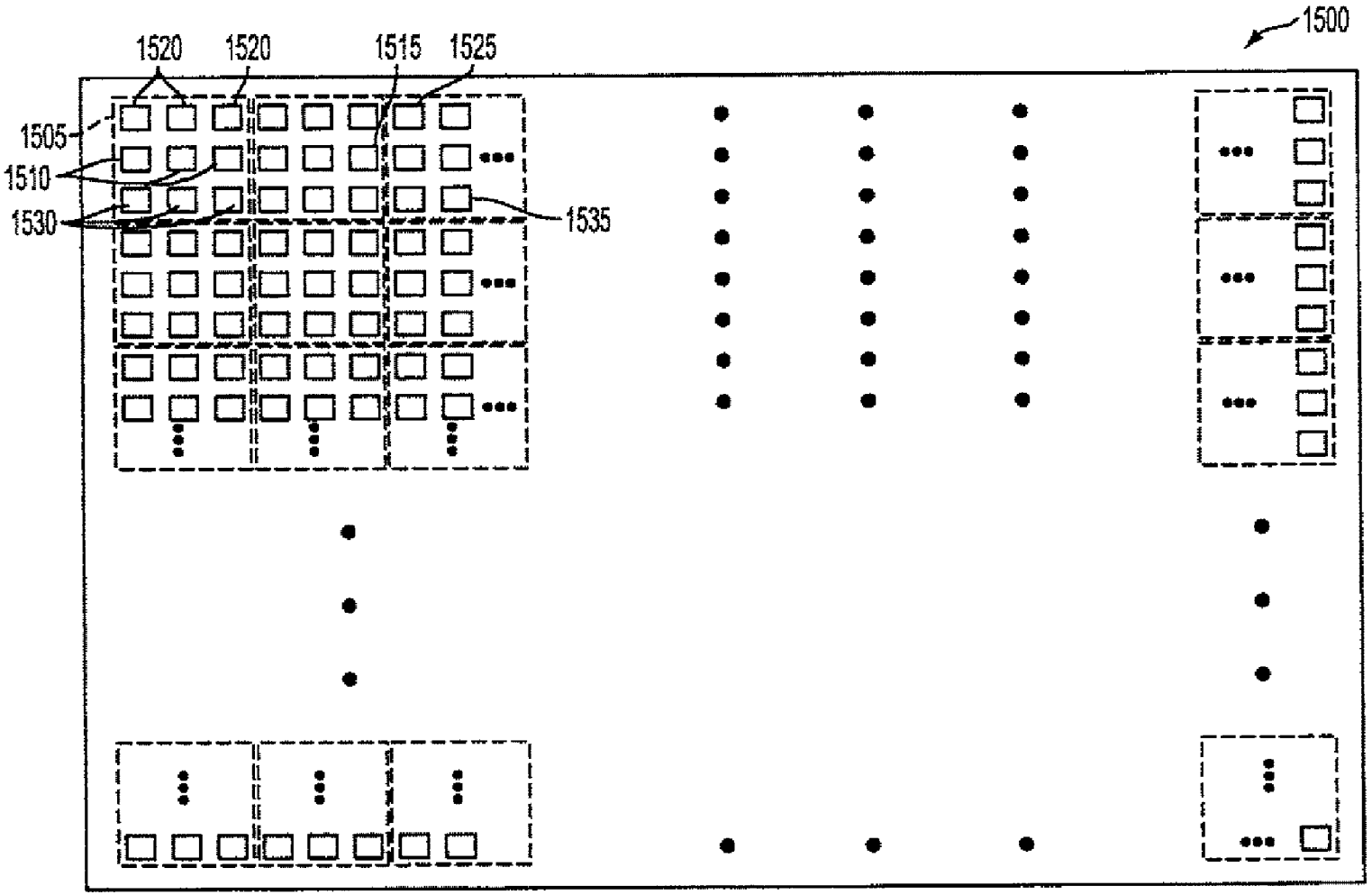
FIG. 15 shows an exemplary two dimensional detector.

Detector 140 may also contain sensors for detecting aberrant conditions. For example, sensors may be provided beyond the starting and ending positions of a scan line so that a deviation from a desired scan line starting and ending positions may be detected. Also detector 140 may include multiple lines of sensors forming a two-dimensional detector 140 for detecting aberrations in the slow scan direction 230, as shown in FIG. 15 and discussed in more detail below.

Figure 5:
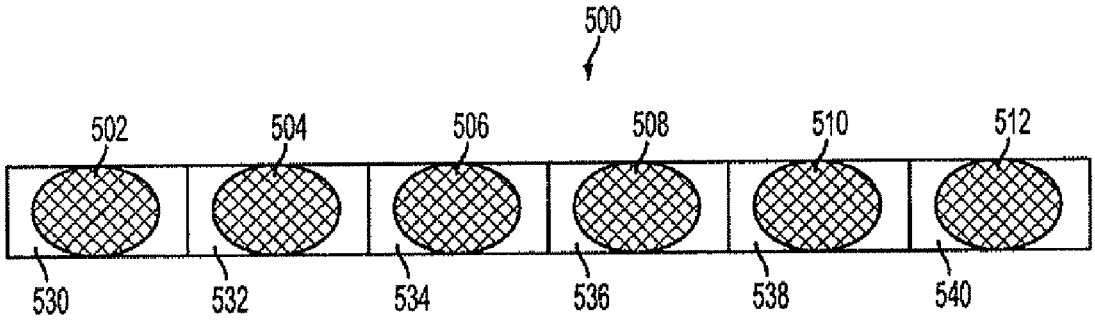
FIG. 5 show an exemplary desired spot pattern.
Figure 6:
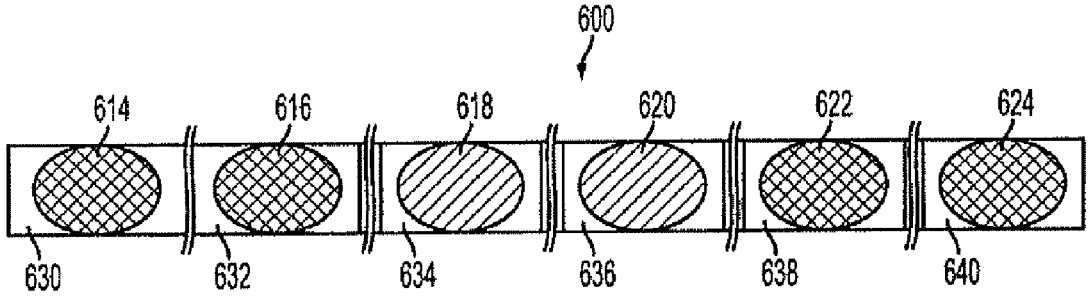
FIG. 6 show an exemplary smile pattern.

A complete scan line may include thousands of dots. While every dot may be detected and processed to detect possible aberrations that may occur, samples of the scan line may be used instead of the complete scan line for detection and correction processing. FIGS. 5 and 6 show 6 such samples. Also, while in most cases the samples should be evenly distributed across the scan line, non-uniform distributions may be desirable if particular portions of the scan line require higher detection resolution than other portions based on specific circumstances. The 6 samples shown in FIG. 6 are assumed to be uniformly spaced across the scan line.

FIG. 5 shows an example of dots 502-512 detected by sensor groups 530-540 in a dot pattern 500 where each of dots 502-512 appears centered on each respective sensor group 530-540, and has a same desired intensity. This is a desired condition. FIG. 6 shows sample dots 614-624 detected by sensor groups 630-640 that have intensity aberrations.

FIG. 6 shows a pattern 600 where dots 618 and 620 have intensities less than desired while dots 614, 616, 622 and 624 have desired intensities. Pattern 600 illustrates an exposure non-uniformity aberration, sometimes referred to as smile. In particular, a smile may result when intensity of the light beam 175 received on photoreceptor 195 increases and then decreases, or decreases and then increases. A smile aberration may be a result of environmental effects such as temperature changes that affect reflectivity of a mirror facet 187 of polygon mirror 185 differently at its center than near its edges, for example. In addition, the optical prescription of the optics 180 and 188 in the system can also vary with these environmental effects.

FIG. 7 shows detected data 700 arranged in a two dimensional table, where one dimension corresponds to facets F1-Fn of polygon mirror 185, and the other dimension corresponds to positions BP1-BPm of detector 140 along fast scan direction 240. Positions BP1-BPm may correspond to sensor groups, such as sensor groups 530-540, for example. The number n may be a total number of mirror facets 187 and m may be a total number of detection positions. Although a two dimensional table is shown in FIG. 7, detected data 700 may be arranged in any number of dimensions. For example, if variation in time is important, then a dimension corresponding to time may be added, or if all facets F1-Fn behave substantially the same, a one dimensional table that contains an average value for all facets F1-Fn may be arranged.

Entries in detected data 700 may contain values detected at each of the corresponding detector positions BP1-BPm. These values may be any type of detectable values such as horizontal or vertical dot positions or dot intensity, etc. A new dimension may be added to accommodate each additional type of detected value, for example.

Assuming that the values shown in FIG. 7 are intensity values, and an intensity value of 250 microwatts is desired, then detected values corresponding to facet F2 indicate a smile aberration due to lower than desired intensities of 230 microwatts at BP3 and BP4 positions while detected values at other positions BP1, BP2, BP5 and BP6 for facet F2 and for all other facets are at desired values of 250 microwatts. Correction controller 110 may process detected data 700 to identify and correct errors such as the smile aberration by generating or updating a correction map.

As noted above, positions BP1-BPm maybe distributed uniformly across a scan line. Thus, while adjacent in detected data 600, positions BP3 and BP4 may be physically separated by many pixel positions. Low intensity values of facet F2 between BP3 and BP4 may indicate that transmitted and reflected beams 175A and 175B have low intensities for all pixels between positions BP3 and BP4. Assuming that these low intensity values are substantially uniform between BP3 and BP4, these pixels may be corrected by increasing driving current of light beam emitter 170 based on the current-intensity characteristics of light beam emitter 170. The amount of increase may be stored in a correction map 800 as shown in FIG. 8, for example.

FIG. 8 shows a two-dimensional correction map 800 where the vertical dimension corresponds to facets F1-Fn of polygon mirror 185, and the horizontal dimension corresponds to correction positions CP1-CPk of the transmitted beam 175A along the fast scan direction 240. While correction map 800 may provide correction of every pixel for every facet of F1-Fn, in a particular situation such as a smile aberration of detected data 700, less than all of the pixel values require correction. Thus, actual stored values of correction map 800 may be a smaller number than shown. Although two dimensions are shown in FIG. 8, correction map 800 may have any number of dimensions as may be required for correction.

Correction map 800 makes corrections based on detected data, such as detected data 700, to correct aberrations detected along facet F2. Thus, all of the entries in rows other than the row corresponding to facet F2 contain "0", because F2 is the only facet showing an aberration to be corrected (a smile, in this case). In facet F2, pixels between CP3 and CP4 may benefit from an intensity boost.

While correction map 800 assumes uniform correction between CP3 and CP4, various other assumptions can be made resulting in non-uniform corrections. In particular, adaptive correction system 100 may analyze detected data and perform curve fitting operations to model the detected data. For example, facets F1-Fn may have been well characterized. Thus, actual effects of a dependency of facet reflectivity on environmental parameters such as temperature or humidity may be determined based on detected data 700.

For example, the detected intensities for facet F2 may be sufficient to determine transmitted beam intensities for all pixels of scan lines generated based on facet F2. Adaptive correction system 100 may generate correction map 800 for facet F2 based on curve fitting techniques or interpolation techniques, etc., to generate proper correction values for obtaining desired transmitted beam intensities for facet F2. This correction process may be executed on a continuous basis as device operation allows so that environmental effects on characteristics of transmitted beam 175 may be adaptively corrected as the environment changes.

Adaptive correction system 100 may correct various aberrations based on a correction map, such as correction map 800, by controlling driver 160, for example, to correct the smile aberration discussed above. In particular, the intensity of light beam 175 may be adjusted by adjusting a current value that drives light beam emitter 170.

Figure 9:
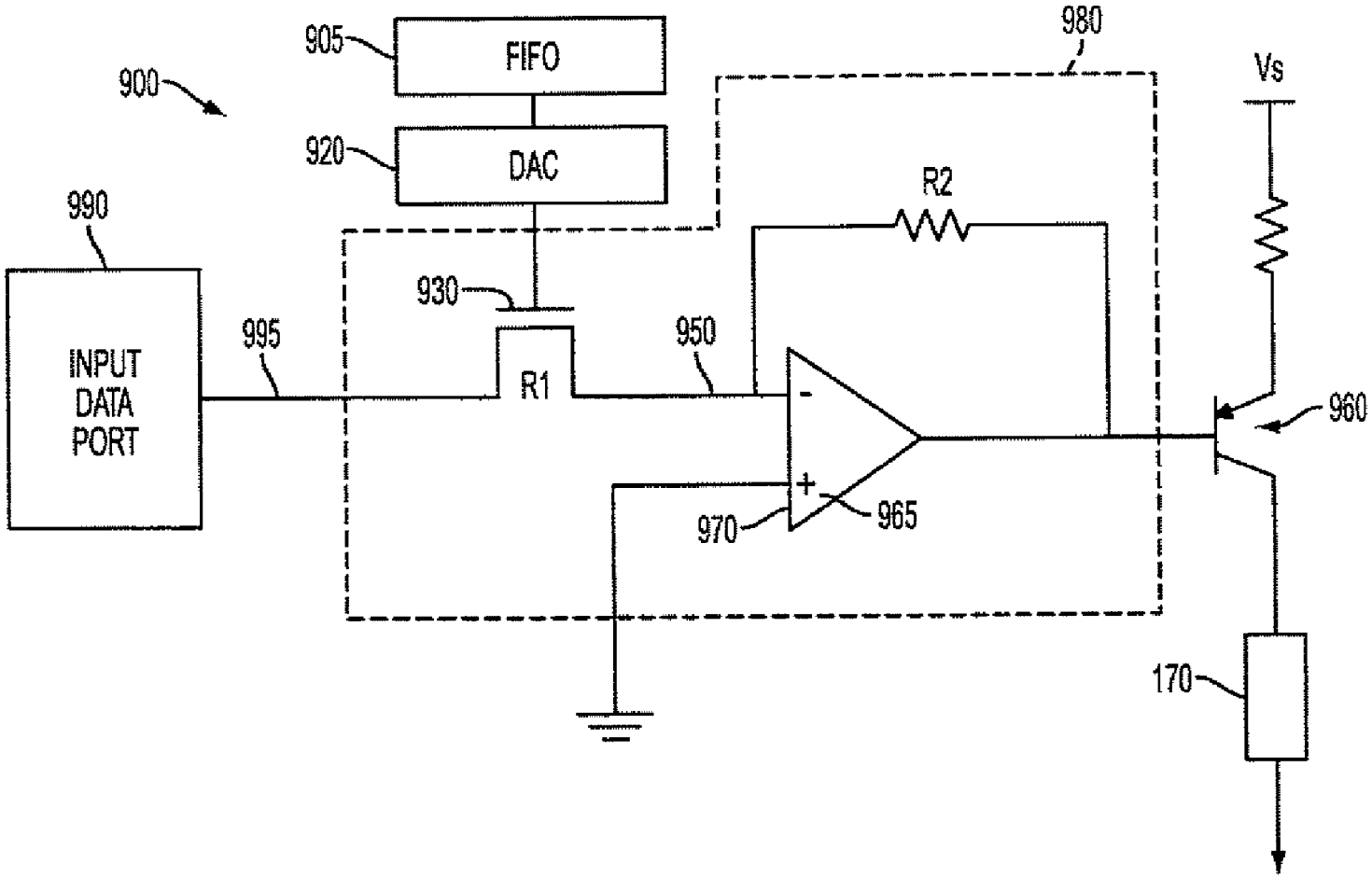
FIG. 9 shows an exemplary driver circuit.

FIG. 9 shows an exemplary driver circuit 900 that may be included in driver 160 for driving light beam emitter 170 based on correction parameters derived from correction data 800. Driver circuit 900 may include a FIFO 905, a digital-to-analog converter (DAC) 920, a variable resistor R1, a resistor R2, and an amplifier 965. Amplifier 965, variable resistor R1 (which may be implemented using a transistor 930, for example), and resistor R2 may collectively form an adjustable gain amplifier 980 that has a gain of R2/R1. Thus, the gain may be adjusted by adjusting the value of variable resistor R1.

The gain of adjustable gain amplifier 980 may be controlled by digital values stored in FIFO 905. As an example, FIFO 905 may include entries for all dots generated using every facet F1-Fn of polygonal mirror 185. Thus, for an 8 inch scan line having a resolution of 1200 dots per inch and 6 facets, for example, FIFO 905 may include 1200×6=72000 entries where each entry specifies a gain value for each dot generated using each of the facets F1-Fn. In this way, the intensity of every dot generated using every facet F1-Fn may be controlled in a high bandwidth system.

FIFO 905 may be clocked by an input data clock (that is synchronized with a video clock of adaptive correction system 100), so that a new control signal may be output from FIFO 905 for each input data point. Thus, as data received from input interface 130 is streamed to adjustable gain amplifier 980 in synchronization with input port or data port 990, a unique gain value may be applied to each data point, and the intensity of each dot generated by light beam emitter 170 may be individually adjusted.

As shown in FIG. 9, output of FIFO 905 is converted to an analog value by DAC 920, which in turn controls the gain via variable resistor R1. Input data port 990 may be in the form of binary values of 0s or 1s. When a 1 is received, output of adjustable gain amplifier 980 is converted to a current value by transistor 960 acting as a voltage-to-current converter that results in an adjusted intensity being output by light beam emitter 170. When a 0 is received, the output of adjustable gain amplifier 980 is set to a value that results in a substantially 0 intensity being output from light beam emitter 170.

For the smile aberration example discussed above, only the intensity values of facet F2 need correction. Assuming that only pixels between CP3 and CP4 inclusively need to be corrected by a fixed multiplier value (determined to be some value greater than 1 for a smile, for example), entries of FIFO 905 corresponding to CP3 and CP4 are set to this calculated value while all other entries are set to 1. In this way, intensity of transmitted beam 175A will remain at the desired constant value for all pixels of a printed page.

Detected data 700, correction map 800 and/or FIFO 905 may be optimized, and simple structures may be used, in situations where a number of aberrations are expected to be low. For example, detected data 700 and correction data 700 may store only values that correspond to aberrations, and FIFO 905 may be implemented using a few registers and counters so that consecutive values of 1 may be simply applied while counting a number of video clock pulses instead of using dedicated memory for storing the large number of 1s, for example.

Additionally, while adjustable gain amplifier 980 is discussed as an example, other circuit structures may be used. For example, instead of variable resistor R1, a bank of resistors R1*a* may be provided. One of the resistors in R1*a* may input the input data stream while the other resistors in R1*a* may be connected between a reference voltage via individual switches and positive input of amplifier 965. Data from FIFO 905 may control the switches to be on or off. In this configuration, amplifier 965, resistor R2 and resistor bank R1*a* form a summer so that the intensity of each dot may be adjusted by adding a correction value.

Figure 10:
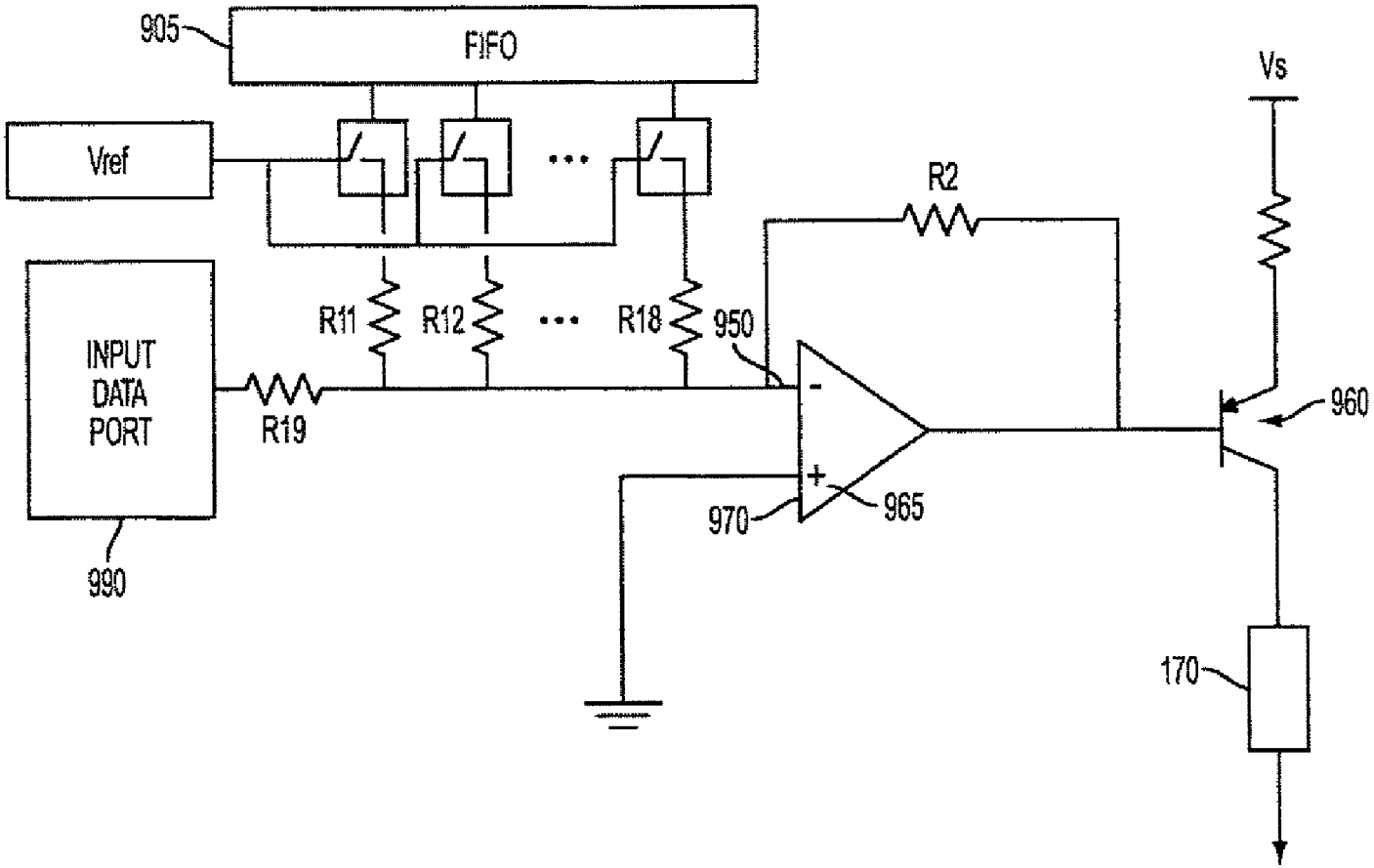
FIG. 10 shows an exemplary driver circuit.

For example, if nine resistors R11-R19 are provided in a binary weighted resistor array or resistor bank R1*a*, as shown in FIG. 10, input data port 990 may connected through R19 and R11-R18 may be set to binary weighted values so that an 8 bit correction value from FIFO 905 may set corresponding switches to increase the intensity of a dot by adding the 8 bit correction value. For the above example, 20 microwatts would be added for pixel values between BP3 and BP4 positions.

Figures 11, 12:
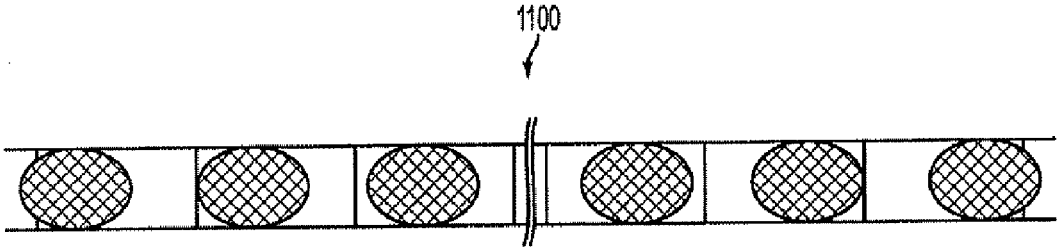
FIG. 11 shows an exemplary scan line non-linearity pattern.
FIG. 12 shows exemplary detected data.

FIG. 11 shows a pattern 1100 that illustrates a scan line non-linearity aberration. Scan non-linearity aberration may be caused by the angular changes of the reflected beam of the polygon. In an uncorrected system, the placement of the spots in the image as the polygon rotates would be a function of the tangent of the scan angle. Post-polygon elements, called F-theta lenses, correct for much of the optical scan linearity, but some residual non-linearity may remain. The remaining error may be fixed by adding electronic modulation of the pixel clock frequency during the scan line time. See, for example, U.S. Pat. No. 4,860,237 to Curry.

FIG. 11 could also represent another aberration, scan line magnification, which could have a similar appearance to scan line non-linearity, but represents a distinct phenomenon. In particular, although both scan line non-linearity and scan line magnification may result in spots, which are intended to be evenly spaced across the scan line, appearing more and more in adjacent (overlapping) sensor groups, as seen in FIG. 11, magnification also results in the scan line expanding beyond, or shrinking beneath, its intended length. That is, in a scan line magnification aberration a length of a scan line appears magnified so that a scan line becomes longer (positive magnification) or shorter (negative magnification) than a desired scan line. For example, pattern 1100 shows a sequence of light pulses in which dots of pixels are increasingly disposed in locations of adjacent pixels. As noted above, sensor groups may include several sensors such as groups 410 and 420 shown in FIG. 4.

Scan line magnification aberration may be caused by motor 193 driving polygonal mirror 185 either too fast or too slow relative to the pulse timings of light beam 175 for example. If this is the case, then the scan line magnification aberration would appear for all facts F1-Fn. Other variations such as physical deformation of polygonal mirror 185 so that one of facets F1-Fn becomes curved, for example, may result in magnification aberration only in a single facet F1-Fn. Correction for the scan line magnification aberration may be determined by sensing the start and end points of the scanned line and calculating the difference between the actual scan line and the desired scan line, for example.

Returning to the discussion of scan line non-linearity, as the polygon facets deform due to the high rotational speeds, thereby changing the reflected angle of the beam for a given rotational position, and also as both the polygon and the post-polygon optics are affected by environmental effects, electronic correction of scan line non-linearity may benefit from re-optimization. The following discussion assumes that all the facets F1-Fn exhibit substantially the same scan non-linearity aberration. However, the discussion may be applicable to any type of scan non-linearity aberration.

Sensors of detector 140 may be disposed so that the middle two sensors detect a dot when properly positioned and the sensors on either side serve as guard sensors and are activated only when the dot is out of its proper position. For dot position detection, an intensity threshold may be determined so that a sensor output is a 1 if a detected intensity exceeds a threshold and a 0 if the detected intensity is below the threshold. Thus, each sensor group may be represented by a 4 bit pattern. For example, 0110 may represent a properly positioned dot.

FIG. 12 shows detected data 1200 based on pattern 1100 occurring in facets F1-Fn. Entries of all facets F1-Fn at dot positions BP3 and BP4 include sensor patterns 0110 showing that each corresponding dot is located in the desired position. However, at BP1, BP2 and BPm dot positions, aberrations are detected. For example, at BP1, the detected pattern is 1000 indicating that the dot at this position has shifted to the left and only the right edge is detected by the left guard sensor.

FIG. 13 shows a possible correction map 1300 for correcting scan line non-linearity 1100. Each of CP1, CP2 and CPk has entry values of −2, −1 and 2, respectively, indicating that the dots at CP1 and CP2 should be moved 2 and 1 position increments to the right, respectively, and dot position at CPk should be moved 2 position increments to the left.

As noted above, a sync pulse may be provided that corresponds to each facet F1-Fn, and a sequence of dots of a scan line may correspond to a sequence of pulses that drives light beam emitter 170 via driver 160. Accordingly, increasing or decreasing the time that each pulse is applied by changing the frequency of the pixel clock to light beam emitter 170 changes the position of the corresponding dot to the right or left, respectively, in the scan line.

As noted in connection with FIG. 7, entries in detected data 1200 at BP1-BPm positions represent a relatively small portion of the total number of dots of a scan line. Thus, there may be many dots in between each of the positions BP1-BPm, that may also need to be repositioned to correct the scan non-linearity aberration. If it is assumed that dot position aberrations are distributed in a known manner based on accurate characterization of the polygonal mirror 185, for example, then the scan non-linearity aberration may be corrected for all the dots by appropriately modifying the positions of associated variable pulses based on known properties of polygonal mirror 185 and correction map 1300, for example.

Figure 14:
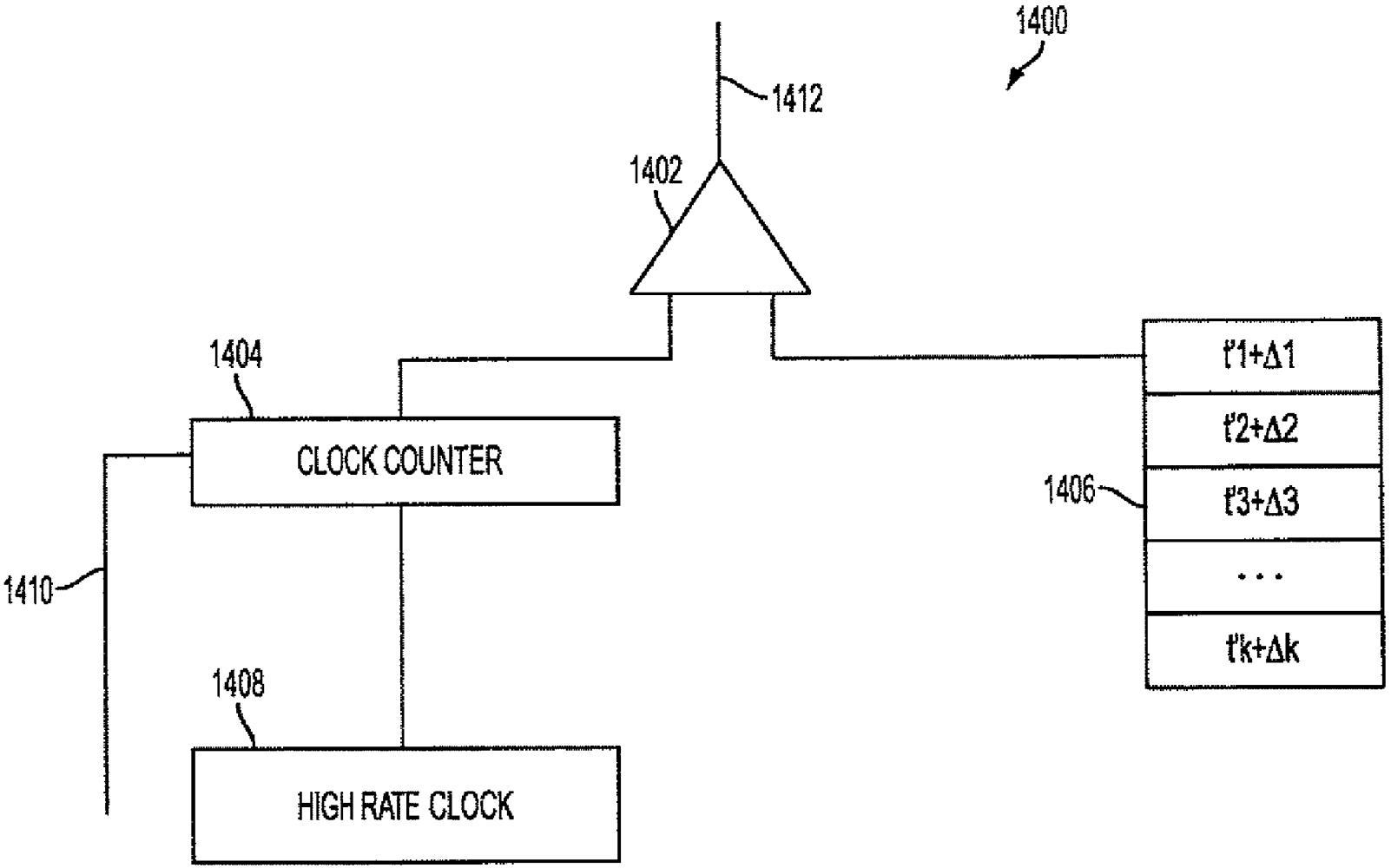
FIG. 14 shows an exemplary high frequency timing circuit.

An exemplary circuit 1400 shown in FIG. 14 may be included in driver 160, for example, to perform the above described pulse start time correction to correct a magnification aberration. Circuit 1400 may include a comparator 1402 that compares a value of a clock counter 1404 against corrected pulse start times output from a FIFO 1406. Counter 1404 counts a number of clock pulses output from system clock 1408 after the sync pulse received on start line 1410. When a count value of counter 1404 matches the output value of FIFO 1406, a comparator output 1412 of comparator 1402 becomes active and triggers driver 160 to output a next pulse that results in light beam emitter 170 generating a dot. FIFO 1406 also receives comparator output 1412 and increments its pointer to output a value corresponding to a next pulse start time. In this way, magnification aberration may be corrected for every dot of a scan line.

While the above describes correcting pulse start times, circuit 1400 may also be used to correct pulse widths. Scan non-linearity aberration may also result in pulse widths becoming either too long or too short. As discussed above, dots may be repositioned by correcting pulse start positions. However, the repositioned pulses may be either too wide or too narrow and may result in unacceptable image outputs. Therefore, the clock frequency is not only frequency modulated to provide new positional placement of the spot, but it is also frequency modulated to provide a correction for the tangential (or fast scan) spot size within a given region of the polygon.

The above described circuit 1400 may correct any types of non-uniform positioning of dots along a scan line. Depending on particular irregularities of facets F1-Fn, dots may be positioned too closely or too far apart in regular or irregular patterns. Detector 140 may be provided with sufficient number of sensors and sensor groups to detect such aberrations. Additionally, pulse widths may be too wide or too narrow, resulting in width aberrations, in which light spots that are too large or too small. All of these aberrations may be corrected by comparing the detected positions and widths with previously known desired or expected positions and widths, and repositioning the start and stop positions of light spots by correcting pulse start and stop times, as discussed above.

In addition to correcting positional aberrations using circuit 1400 to modify the start times of pulses, positional aberrations may also be corrected by slowing or accelerating the speed of polygon mirror 185. Thus, adaptive correction system 100 may first detect positional aberrations, then calculate the appropri ate acceleration or deceleration of polygon mirror 185 to generate a correction map (including, for example, curve fitting detected data), and then use the calculated values in the correction map to accelerate or decelerate polygon mirror 185 to correct the positional aberration.

Aberrations causing the non-uniform dot positions discussed above occur in the fast scan direction. Similar aberrations may occur in the slow scan direction, such as bowing aberration, for example. To detect bowing aberration, detector 140 maybe modified into detector 1500 that may include two dimensional sensors and sensor groups, as shown in FIG. 15.

FIG. 15 shows a two dimensional detector 1500 for detecting reflected beam 175B along two substantially different (horizontal and vertical dimensions). In particular, detector 1500 contains sensor groups such as group 1505, which contains three middle row sensors 1510, three top row sensors 1520, and three bottom row sensors 1530. Detector 1500 contains other sensors groups, extending in both the horizontal and vertical directions. For example, a sensor group to the right of group 1505 contains a sensor 1515 in the same middle row as sensors 1510, and a sensor group even farther to the right contains sensors 1525 and 1535, in the same top and bottom rows as sensors 1520 and 1530, respectively.

Detector 1500 may detect a desired light beam, such as reflected beam 175B, across the middle row in any series of horizontally contiguous sensors. In particular, desired light spots may impinge upon the sensor, such as the middle sensor among sensors 1510, in the center of each sensor group. Furthermore, detector 1500, like detector 140, may also only detect a sample of reflected beam 175B as the beam sweeps across the scan line direction.

The sensors in the top and bottom rows of corresponding sensor groups, such as sensors 1520 and 1530 in group 1505, allow detector 1500 to detect aberrations in the vertical dimension, such as bowing. For example, although a desired reflected beam 175B may sweep across only sensors in the middle row, such as sensors 1510, a bow may occur when transmitted beam 175A, and therefore also reflected beam 175B, deviates in the vertical direction, to sweep across any of the sensors in the top and bottoms rows, such as sensors 1520 and 1530.

Bowing aberrations may be corrected by many methods. If light beam emitter 170 includes multiple emitters positioned so that respective dots are separated in the slow scan direction, then small bowing aberrations may be corrected by selecting a different light emitter. If large bowing aberration is detected, then operational data remapping may be beneficial.

For example, suppose that some of the dots are desired to appear on line L, but instead appear on line L+1 (one line after line L) because of bowing. Then software and/or hardware may alter the data generating line L−1 (one line preceding line L), so that line L−1 includes data for generating the dots intended for line L which had previously been drawn incorrectly as line L+1 because of the bowing. In that case, the bowing in adaptive correction system 100 will cause the dots in the data for line L−1 to appear in line L, as desired.

Figure 16:
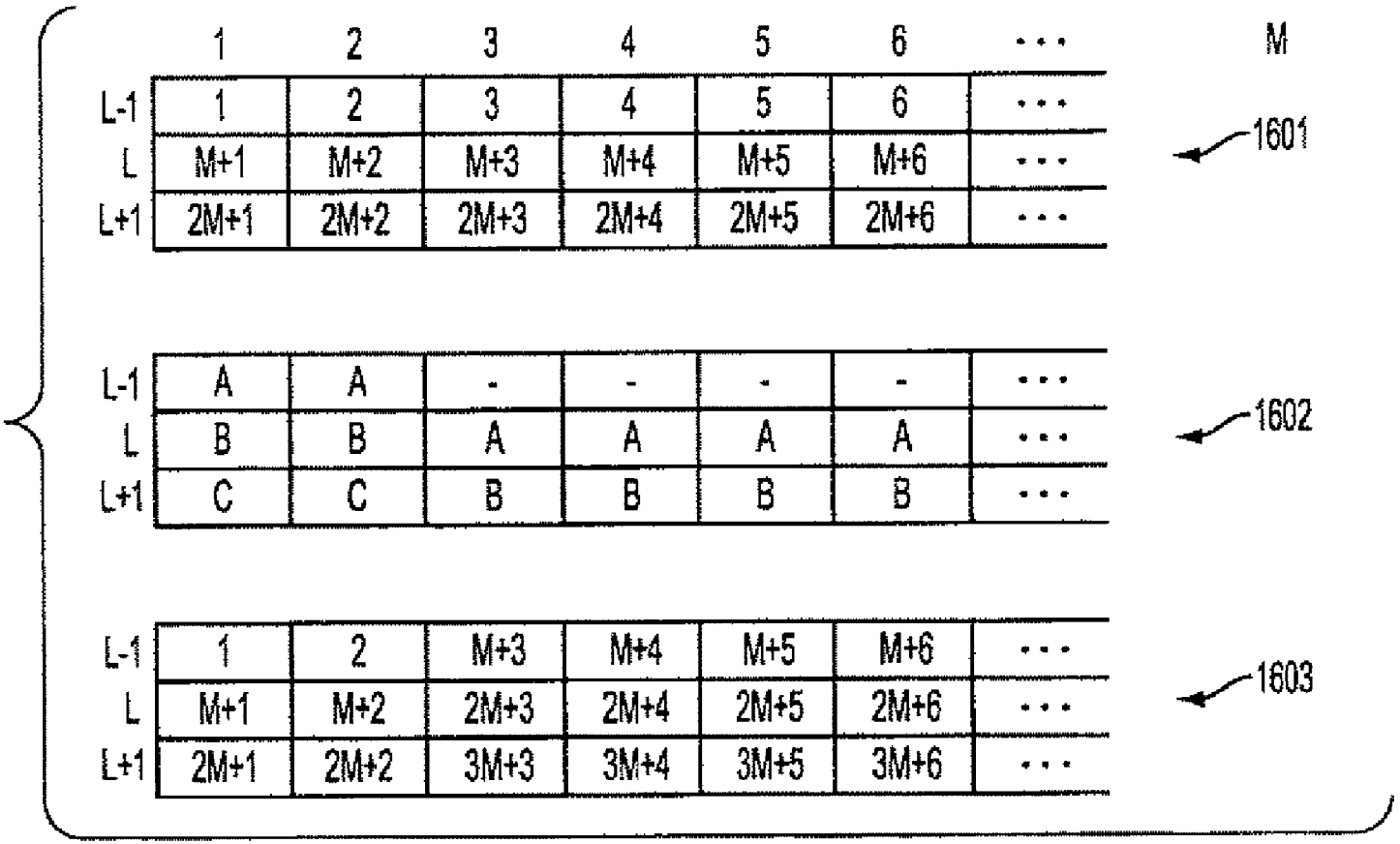
FIG. 16 shows an exemplary bowing correction.

FIG. 16 shows an example of correcting bowing aberration, as described above. Data portion 1601 contains the order numbers for sending data to driver 160. For example, the first position in line L−1 of data portion 1601 contains a "1" for writing the intended spot. Similarly, the first position in line L contains "M+1", because that location corresponds to writing the next spot after all of the first through M spots for line L−1 have been written. For purposes of discussion, data corresponding to line L−1 are labeled as A, data corresponding to line L are labeled as B, and data corresponding to line L+1 are labeled as C.

For a bowing aberration, data portion 1601 may be written onto photoreceptor belt 195 as shown in output portion 1602. Thus, some of the data of line L−1 are written to line L, for example. Similarly, some of the data of line L are instead written to line L+1.

Bowing aberrations may be corrected by reordering the data as shown in data portion 1603. In this way, when line L−1 is written, the data corresponding to line L will be written onto proper positions. Thus, bowing aberrations may be corrected by processing the operational data in a compensating order. Operational data reordering and emitter selection may be used together to compensate for bowing aberrations.

Figure 17:
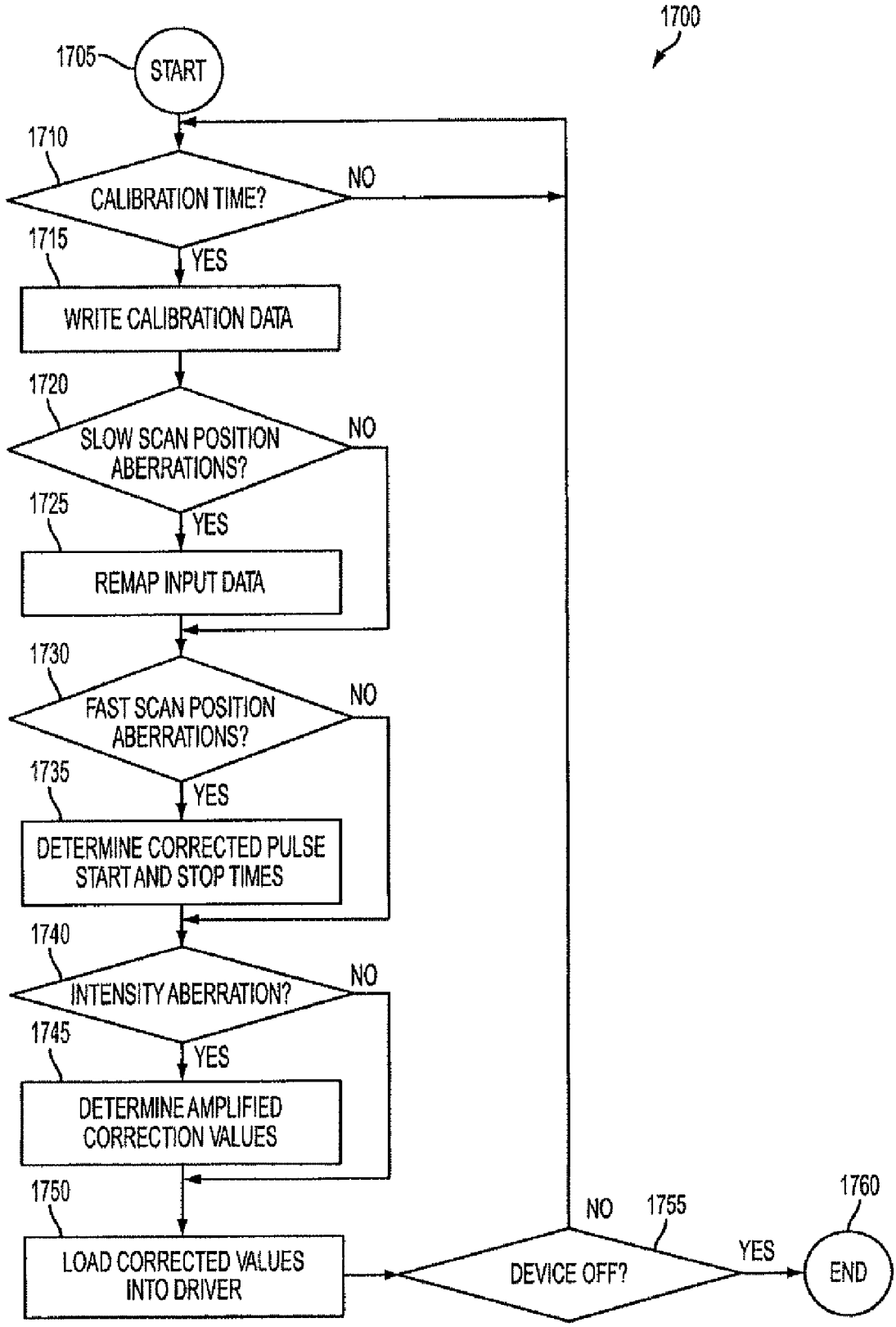
FIG. 17 shows an exemplary flow chart.

FIG. 17 shows a flow chart 1700 for an exemplary process that performs adaptive correction for a device. In particular, FIG. 17 shows a process which may correct both intensity aberrations, such as those shown in FIG. 5, as well as position aberrations, such as scan line magnification and bowing using the adaptive correction system and techniques discussed above. Although the process may correct both position and intensity aberrations, one may also just correct one type of aberration, or more than two aberrations, including other types of aberrations than intensity and position.

The process begins at step 1705 and goes to step 1710. In step 1710, a determination is made whether the device is currently in a state in which adaptive correction is preferably performed, such as a state in which more resources are available for performing adaptive correction. For example, correction may be performed when the device is (i) in between print jobs, (ii) in between pages of a print job, and (iii) in a wait state, for example. If the device is not currently in a preferred state for performing adaptive correction, the process returns to step 1755.

However, if adaptive correction can be performed, the process goes to step 1715. In step 1715, the process writes calibration data to a photoreceptor, for example, and goes to step 1720. In step 1720, the process determines whether a slow scan aberration, such as bowing, exists. If bowing is detected, the process goes to step 1725; otherwise, the process goes to step 1730.

In step 1725, the process corrects the slow scan position aberrations by either selecting an appropriate light emitting element if available, or remapping operational data, or both, and goes to step 1730.

At step 1730, the process determines whether a fast scan aberration, such as magnification or scan non-linearity, exists. If aberration in the fast scan direction is detected, the process goes to step 1735, otherwise the process goes to step 1740.

In step 1735, the process corrects the fast scan aberration by changing pulse timing of light beam emitter 170, for example, and the process goes to step 1740.

At step 1740, the process determines whether an intensity aberration exists. If an intensity aberration is detected, then the process goes to step 1745; otherwise, the process goes to step 1750. In step 1745, the process corrects the intensity aberration and goes to step 1750.

At step 1750, the process applies the corrected values generated in steps 1725, 1735, and/or 1745, for example, to drive the light emitting elements to correct the detected aberrations and goes to step 1755. If the device is turned off, then the process goes to step 1760 and ends; otherwise, the process returns to step 1710.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. An image forming device that includes an adaptive correction system, comprising:

a light beam driver;

a detector that detects one or more characteristics of a light beam during available periods while the device is performing an operational process;

a controller that determines that an aberration exists based on data obtained by the detector and controls the light beam driver to compensate for the aberration while the device is performing the operational process;

a light emitting device that emits the light beam; and a beam splitter that splits the light beam into a first beam and a second beam, the first beam scanning across a photoreceptor of the device and the second beam scanning across the detector in a manner that corresponds to the first beam scanning across the photoreceptor, wherein the detector detects the second beam to produce the data and the controller controls the light beam driver based on the data, and the controller compensates for an aberration in a slow scan direction based on the characteristics detected by the detector by reordering operational data from a received order to a compensating order.

2. The device of claim 1, the detector comprising a plurality of sensors arranged in an array, the sensors being disposed to detect multiple positions of the light beam as the light beam scans across the detector.

3. The device of claim 2, wherein the sensors are grouped into sensor groups, each of the sensor groups corresponds to a specific position on the photoreceptor, sensors of each of the sensor groups detecting an intensity and a position of the first laser beam based on an intensity and a position of the second beam detected by the sensors.

4. The device of claim 1, the light beam driver comprising:

an amplifier;

a memory storing correction values generated by the controller; and an input port that inputs operational data, wherein the light emitting device is driven by the amplifier based on the correction values in the memory and the operational data.

5. The device of claim 4, the light beam driver further comprising:

a voltage-to-current converter that converts a voltage output of the amplifier to a current to drive the light emitting device; and a digital-to-analog converter that converts a digital correction value received from the memory to an analog correction value, wherein the analog correction value adjusts a gain of the amplifier for a corresponding data value of the operational data to compensate for an intensity aberration associated with the corresponding data value of the operational data.

6. The device of claim 4, the light beam driver further comprising:

a voltage-to-current converter that converts a voltage output of the amplifier to a current to drive the light emitting device; and a binary weighted resistor array, wherein a digital correction value is applied to the binary weighted resistor array that adds a correction value to a corresponding data value of the operational data to compensate for an intensity aberration associated with the corresponding data value of the operational data.

7. The device of claim 1, the light beam driver comprising:

a comparator;

a clock counter counting a clock signal; and a memory that stores a plurality of correction values, wherein the comparator outputs a pulse start signal when a count value of the clock counter matches a first time correction value in the memory to compensate for a position aberration of the first beam position corresponding to the first time correction value.

8. The device of claim 7, wherein the comparator outputs a pulse stop signal when a count value of the clock counter matches a second time correction value in the memory to compensate for a width aberration of the first beam corresponding to the first and second time correction values.

9. The device of claim 1, wherein the controller further compensates for an aberration in a slow scan direction based on the characteristics detected by the detector by selecting one of a plurality of light emitters of the light beam driver.

10. The device of claim 1, wherein the controller controls the light beam driver to compensate for an intensity aberration and a positional aberration.

11. The device of claim 1, wherein the device is a xerographic image forming device.

12. A method that compensates for aberrations in a image forming device, comprising:

detecting a characteristic of a light beam while an operational process is performed to generate detected data;

determining that an aberration exists based on the detected data; and controlling the light beam to compensate for the aberration during the operational process, the aberration including slow scan direction aberrations and fast scan direction aberrations, and the controlling compensates for an aberration in the slow scan direction based on the characteristic detected by reordering operational data from a received order to a compensating order.

13. The method of claim 12, further comprising:

splitting the light beam into a first beam and a second beam;

scanning the first and second beams so that characteristics of the first and second beams corresponds to each other;

disposing a photoreceptor in a first position and a detector in a second position; and arranging the first and second positions so that a third position of the first beam on the photoreceptor and a fourth position of the second beam on the detector correspond to each other.

14. The method of claim 13 further comprising:

generating an intensity correction value based on a position and an intensity of the second beam; and setting a light intensity of the light beam based on the intensity correction value and operational data.

15. The method of claim 14 further comprising generating the intensity correction values as at least one of a proportion of a desired intensity divided by intensity values of the second beam or a delta value, a sum of the delta value and an intensity value of the second beam resulting in the desired intensity value.

16. The method of claim 13 further comprising:

counting clock pulses associated with operational data to generate a count value;

generating a time correction value based on the fourth position of the second beam; and outputting a pulse start signal when the count value matches a first time correction value to compensate for a position aberration of the first beam corresponding to the first time correction value.

17. The method of claim 16, further comprising:

outputting a pulse stop signal when a count value matches a second time correction value to compensate for a width aberration of the first beam corresponding to the first and second time correction values.

18. A xerographic image forming device that includes an adaptive correction system, the device comprising:

means for detecting a characteristic of a light beam while the device is performing an operational process;

means for driving a light beam emitter; and means for determining that an aberration exists based on data obtained by the detecting means and for generating correction values to control driving means to compensate for the aberration while the device is performing the operational process, wherein the driving means drives the light beam emitter based on the correction values to correct intensity, slow scan direction and fast scan direction aberrations, and the means for determining compensates for an aberration in a slow scan direction based on the characteristic detected by the means for detecting by reordering operational data from a received order to a compensating order.

* * * * *